US006079785A

United States Patent [19]

Peterson et al.

[11] Patent Number: 6,079,785

[45] Date of Patent: Jun. 27, 2000

[54] CHAIR HAVING ADJUSTABLE LUMBAR SUPPORT

[75] Inventors: Gordon J. Peterson, Rockford; Larry DeKraker, Holland; Jeffrey A. Hall; Kurt R. Heidmann, both of Grand Rapids; Glenn A. Knoblock, Kentwood, all of Mich.

[73] Assignee: Steelcase Development Inc., Grand Rapids, Mich.

[21] Appl. No.: 09/228,726

[22] Filed: Jan. 12, 1999

[51] Int. Cl.[7] ..... A47C 3/025

[52] U.S. Cl. ..... 297/284.7; 297/284.8; 297/284.5

[58] Field of Search ..... 297/284.4, 284.1, 297/284.7, 284.8, 284.5; 29/428

[56] References Cited

U.S. PATENT DOCUMENTS

| | | |
|---|---|---|
| 1,228,771 | 6/1917 | Hanger . |
| 2,756,809 | 7/1956 | Endresen . |
| 3,095,188 | 6/1963 | Giese . |
| 3,241,879 | 3/1966 | Castello et al. . |
| 4,148,522 | 4/1979 | Sakurada et al. . |
| 4,296,965 | 10/1981 | Sakurada et al. . |
| 4,502,728 | 3/1985 | Sheldon et al. . |
| 4,536,030 | 8/1985 | Sakurada et al. . |
| 4,565,406 | 1/1986 | Suzuki . |
| 4,588,172 | 5/1986 | Fourrey et al. . |
| 4,632,454 | 12/1986 | Naert . |
| 4,715,653 | 12/1987 | Hattori et al. . |
| 4,730,871 | 3/1988 | Sheldon . |
| 5,007,677 | 4/1991 | Ozawa et al. . |
| 5,050,930 | 9/1991 | Schuster et al. . |
| 5,087,098 | 2/1992 | Ishizuka . |
| 5,120,109 | 6/1992 | Rangoni . |
| 5,217,278 | 6/1993 | Harrison et al. . |
| 5,299,851 | 4/1994 | Lin . |
| 5,333,934 | 8/1994 | Knoblock . |
| 5,385,388 | 1/1995 | Faiks et al. . |
| 5,403,069 | 4/1995 | Inara et al. . |
| 5,505,520 | 4/1996 | Frusti et al. . |
| 5,567,011 | 10/1996 | Sessini . |
| 5,641,205 | 6/1997 | Schmidt . |
| 5,685,606 | 11/1997 | Lance . |
| 5,711,575 | 1/1998 | Hand et al. . |
| 5,716,098 | 2/1998 | Lance . |
| 5,769,490 | 6/1998 | Falzon . |

*Primary Examiner*—Milton Nelson, Jr.
*Attorney, Agent, or Firm*—Price, Heneveld, Cooper, DeWitt & Litton

[57] ABSTRACT

A back construction for a chair includes a back shell having a plurality of horizontal bands defining a flexible lumbar section, with the back shell including non-parallel guides defined along its edges. A vertically adjustable lumbar support includes a panel body located at the flexible lumbar section, a bent wire member that engages the panel body and that is stretchable laterally, and opposing handles attached to ends of the bent wire member that engage the non-parallel guides. The opposing handles slidingly follow the guides and are movable between a first position where the bent wire member is flexed to a first width dimension, and a second position where the bent wire member is flexed to a second width dimension different than the first width dimension. Slots in the panel body retain the bent wire member to the panel body, but permit the bent wire member to be stretched horizontally during vertical adjustment of the lumbar support. The panel body includes generously radiused upper and lower edges shaped to slide over top and bottom edges of the plurality of horizontal bands without catching on and unacceptably twisting individual ones of the bands when the vertically adjustable lumbar support is vertically adjusted.

22 Claims, 8 Drawing Sheets

67
69
68

67
65
26
66
25
68

43
46
80
74'
77
74

28'
49
28
49
51
22
23

85
75
75"
75'

52
47
82'
82
83
76

CHAIR HAVING ADJUSTABLE LUMBAR SUPPORT

BACKGROUND OF THE INVENTION

The present invention concerns chairs with adjustable lumbar supports, and more particularly concerns a chair having a vertically adjustable lumbar support apparatus.

Adequate lumbar support is very important to people spending long hours sitting in chairs. However, people have different body shapes and have different preferences. For these reasons, it is not easy to design an adjustable lumbar support that meets the needs of most people, yet that is not unacceptably expensive, complex, and/or difficult to assemble. Further, people require different amounts of lumbar support throughout a workday and different people may use a particular chair. Many different people may use a chair over the life of the chair and it is not always possible to train them on how to best adjust the chair. For this reason, it is desirable to provide an adjustable lumbar support mechanism that is easily adjustable, intuitively adjustable, as well as smoothly functional during adjustment. Another problem is that adjustable lumbar supports must fit within the aesthetics and decor of a particular style of chair. Specifically, many chairs have stylized backs with non-uniform edges, covered front and rear surfaces, and refined edge trimmings, which features increase the complexity of a lumbar support mechanism when it is hidden inside the back.

Recently, a chair was conceived having a very flexible, highly compliant back that flexes in a manner providing excellent postural support, but that is highly sympathetic to the manner in which a seated user flexes their spine, especially in a lumbar area. (The chair is disclosed in application Ser. No. 08/957,473, filed Oct. 24, 1997, by inventors Glenn A. Knoblock et al., entitled Chair Including Novel Back Construction, the entire contents of which are incorporated herein by reference in its entirety.) In this chair, the adjustability of the lumbar support is made more difficult, since the back shell is so flexible in the lumbar area that the lumbar area of the back shell itself changes shape during adjustment of the vertical lumbar support and during flexure of a spine and back of a seated adult user. In order for the lumbar support mechanism to function properly, it must be held against the lumbar area of the back shell during adjustment. This raises several competing functional requirements. When taken in combination with the other functional and aesthetic requirements of this chair, the conflicting design requirements are significant. In addition, it is preferred that this adjustable lumbar support mechanism be retrofittable.

Accordingly, a chair having a footrest solving the aforementioned problems and having the aforementioned advantages is desired.

SUMMARY OF THE PRESENT INVENTION

In one aspect of the present invention, a back construction for a chair includes a back member having a flexible lumbar section, the back member including non-parallel guides defined along opposing side edges of the back member. A vertically adjustable lumbar support includes a panel body located at the flexible lumbar section, a bent wire member that engages the panel body and that is stretchable laterally, and opposing handles that engage the non-parallel guides. The opposing handles engage ends of the bent wire member and are movable between a first position on the guides where the bent wire member is flexed to a first width dimension, and a second position on the guides where the bent wire member is flexed to a second width dimension different than the first width dimension.

In another aspect of the present invention, a lumbar adjustment mechanism includes a lumbar support having a panel body with upper and lower edges, opposing side edges, and retainers. A horizontally extendable carrier includes upper and lower sections that slidably engage the retainers to hold the horizontally extendable carrier adjacent the panel body of the lumbar support, but that are constructed to permit the horizontally extendable carrier to extend horizontally as the panel body of the lumbar support is moved vertically on a chair back.

In yet another aspect of the present invention, a back construction includes a back member having a flexible lumbar section with horizontal slits defining a plurality of horizontal bands, where the lumbar section is flexible and readily bendable to different concave shapes. A vertically adjustable lumbar support includes a panel body configured to vertically slidably engage the flexible lumbar section and bend the flexible lumbar section to a shape generally matching the panel body. The lumbar support further includes at least one handle for moving the panel body, the panel body including generously radiused upper and lower edges shaped to slide over top and bottom edges of the plurality of horizontal bands without catching on and unacceptably twisting individual ones of the bands when the vertically adjustable lumbar support is vertically adjusted.

These and other features, objects, and advantages of the present invention will become apparent to a person of ordinary skill upon reading the following description and claims together with reference to the accompanying drawings.

DETAILED DESCRIPTION OF THE PREFERRED EMBODIMENT

Figure 1:
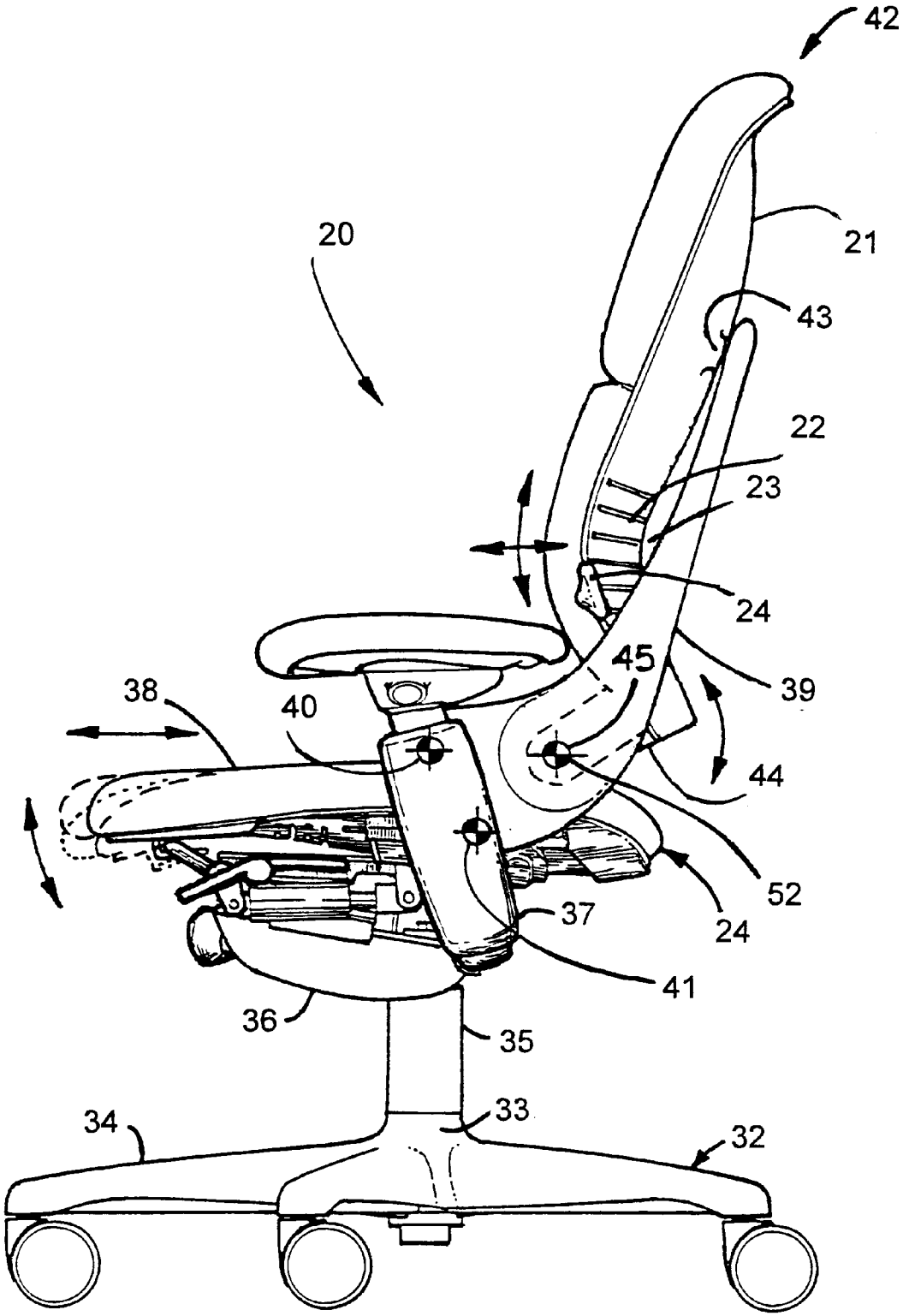
FIG. 1 is a perspective view of a chair embodying the present invention, the chair including a reclineable back and synchronously movable seat, the back including an adjustable lumbar support mechanism.
Figure 3:
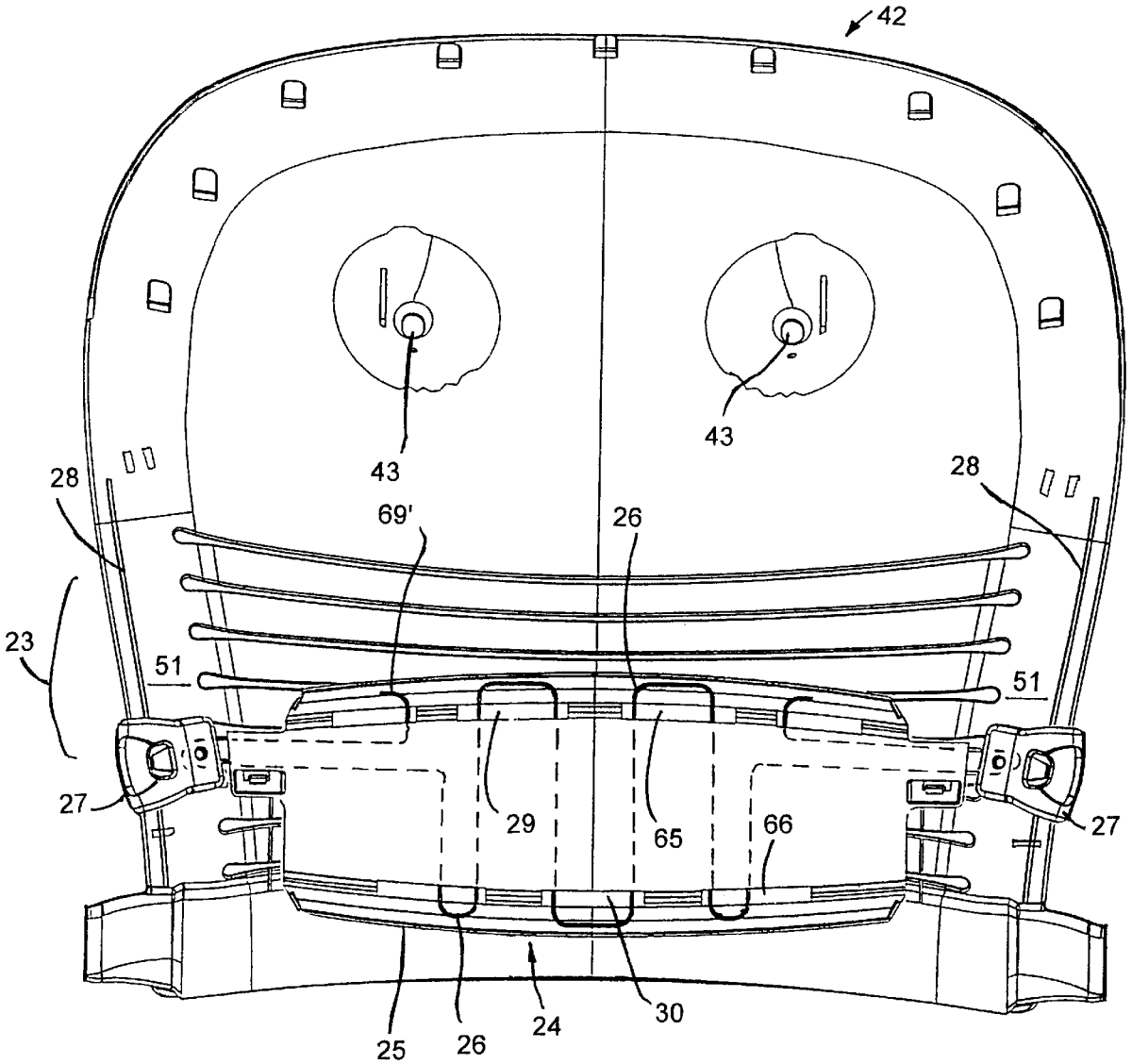
FIG. 3 is a front view of the back shown in FIG. 2, but with the front cushion removed to better show the lumbar adjustment mechanism, and with the lumbar mechanism shown in a lowered position.

A chair 20 (FIG. 1) includes a back shell 21 having a plurality of horizontal bands 22 defining a flexible lumbar section 23. A vertically adjustable lumbar support 24 includes a panel body 25 (FIG. 3) located at the flexible lumbar section 23, a bent wire member 26 that engages the panel body 25 and that is stretchable laterally, and opposing handles 27 attached to ends of the bent wire member 26 that engage non-parallel guides 28 on the back shell 21. The opposing handles 27 slidingly follow the guides 28 and are movable between a first position where the bent wire member 26 is flexed to a first width dimension, and a second position where the bent wire member 26 is flexed to a second width dimension different than the first width dimension. Slots 29 and 30 along top and bottom edges of the panel body 25 retain the bent wire member 26 closely to the panel body 25, but permit the bent wire member 26 to be stretched horizontally during vertical adjustment of the lumbar support 24. By this arrangement, a lumbar support is constructed that is low cost, easily manufactured, easily installed, and yet that provides a very good, adjustable, postural support for the chair 20.

The basic chair 20 is disclosed in application Ser. No. 08/957,473, filed Oct. 24, 1997, by inventors Glenn A. Knoblock et al., entitled Chair Including Novel Back Construction, the entire contents of which were previously incorporated herein by reference in its entirety. A detailed description of the basic chair 20 is not necessary to an understanding of the present invention, except as noted below. The chair 20 (FIG. 1) includes base 32 having a hub 33, radially extending legs 34, and a vertically extending post 35 supporting a control housing 36. A pair of rigid arms 37 extend upwardly adjacent the seat 38, and a back frame 39 is pivoted to the arms 37 at a back pivot 40. The seat 38 is slidably mounted to sidewalls of the control housing 36 and is pivoted to the back frame 39 at seat pivot 41. The back construction 42 includes the back shell 21 pivoted at top locations 43 to the back frame 39, and further includes a belt bracket 44 pivoted at bottom locations 45 to the back frame 39. During recline, the back shell 21 and back frame 39 pivot rearwardly and downwardly about the back pivot 40, while the seat 38 moves forwardly and a rear section of the seat pivots downwardly about seat pivot 41.

Figures 5, 10, 13, 15, 16, 17:
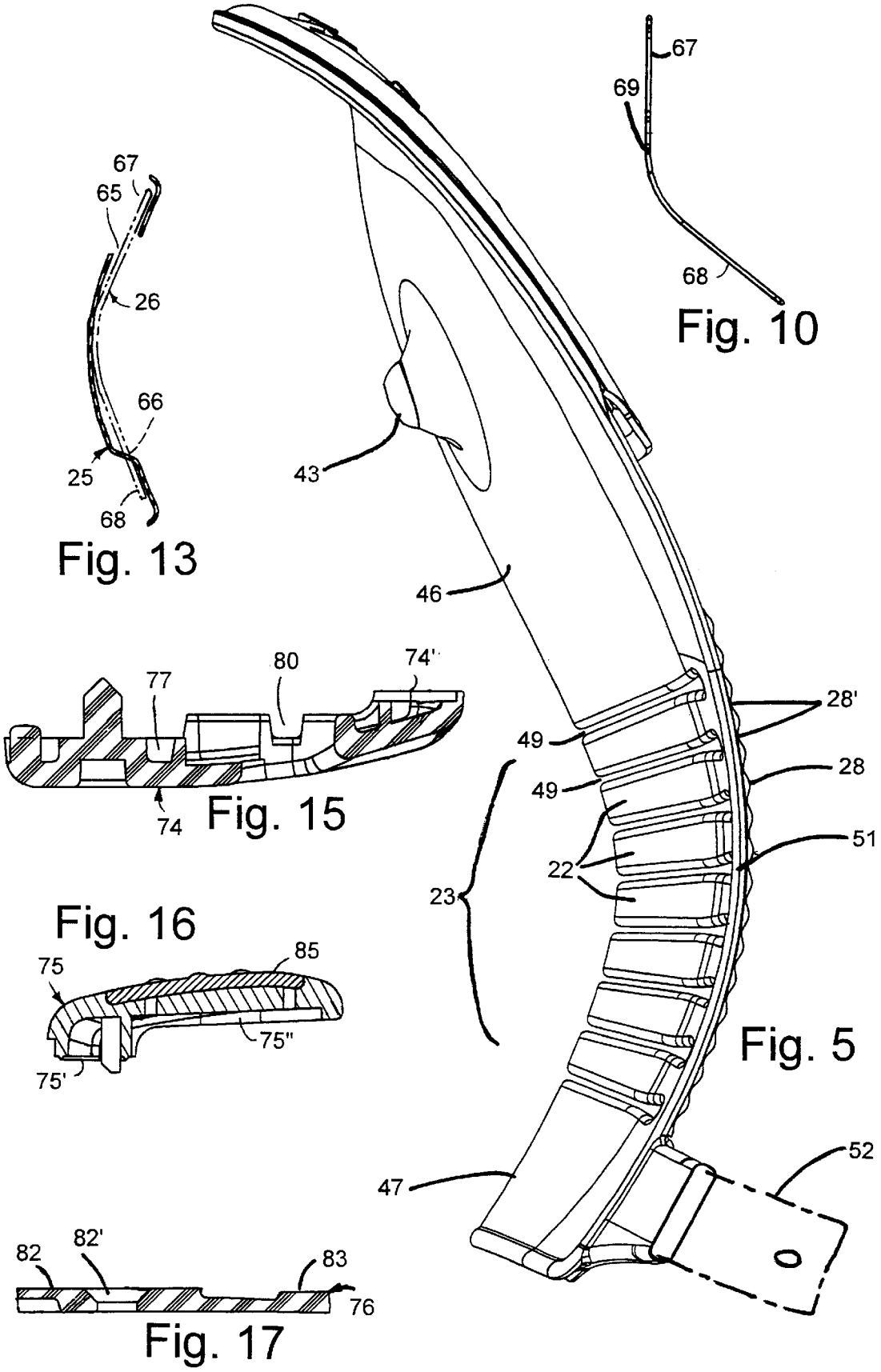
FIG. 5 is a side view of the back shell shown in FIG. 2.
FIGS. 9 and 10 are front and side views of the bent wire member shown in FIG. 6.
FIG. 13 is a cross-sectional view taken along line XIII—XIII in FIG. 12.
FIG. 15 is a cross-sectional view, offset somewhat from its centerline, of a subassembly of the handle body, the handle grip, the Velcro® insert, and the aesthetic rubber insert shown in FIG. 6.
FIG. 16 is a view of the handle body shown in FIG. 15.
FIG. 17 is a cross-sectional view of the spring plate shown in FIG. 6.

The back shell 21 (FIG. 5) includes a relatively stiff thoracic section 46 and a relatively stiff pelvic section 47 connected by the relatively flexible lumbar section 23. A plurality of horizontal slits 49 extend across the lumbar section 23, defining the plurality of horizontal flexible bands 22, which are connected at their ends by leaf-spring-like vertical side bands 51. The lumbar section 23 is very flexible, but the top and bottom locations 43 and 45, in combination with the forward arms 52 of the belt bracket 44, cause the back shell 21 to flex about a particular path. A torsional biasing device is attached at bottom locations 45 to bias the back shell 21 to a forwardly convex shape. The combination of the stiff thoracic and pelvic sections 46 and 47, along with the flexible lumbar section 23 provides a very comfortable, postural support.

Figure 2:
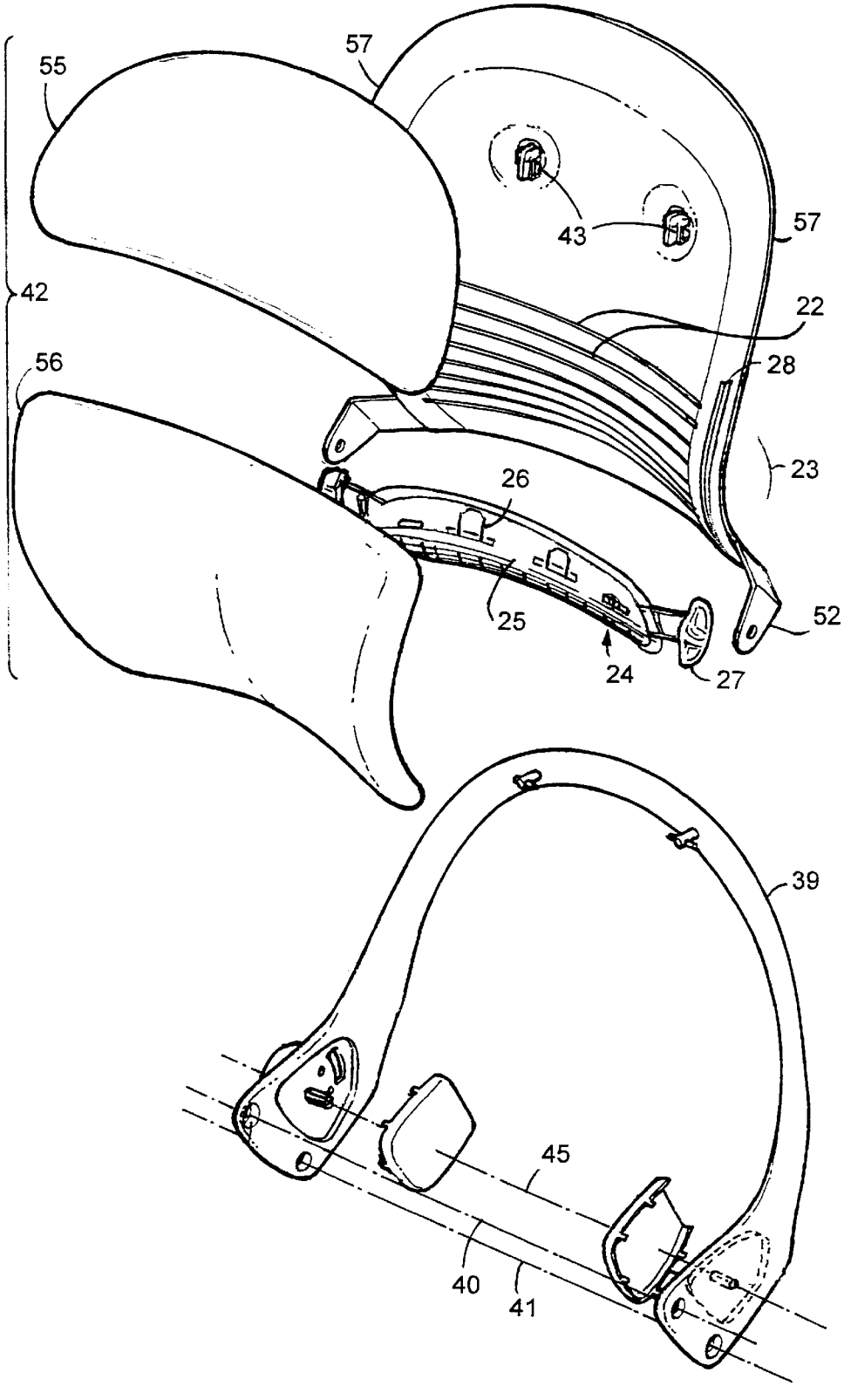
FIG. 2 is a partially exploded view of the back shown in FIG. 1.
Figure 4:
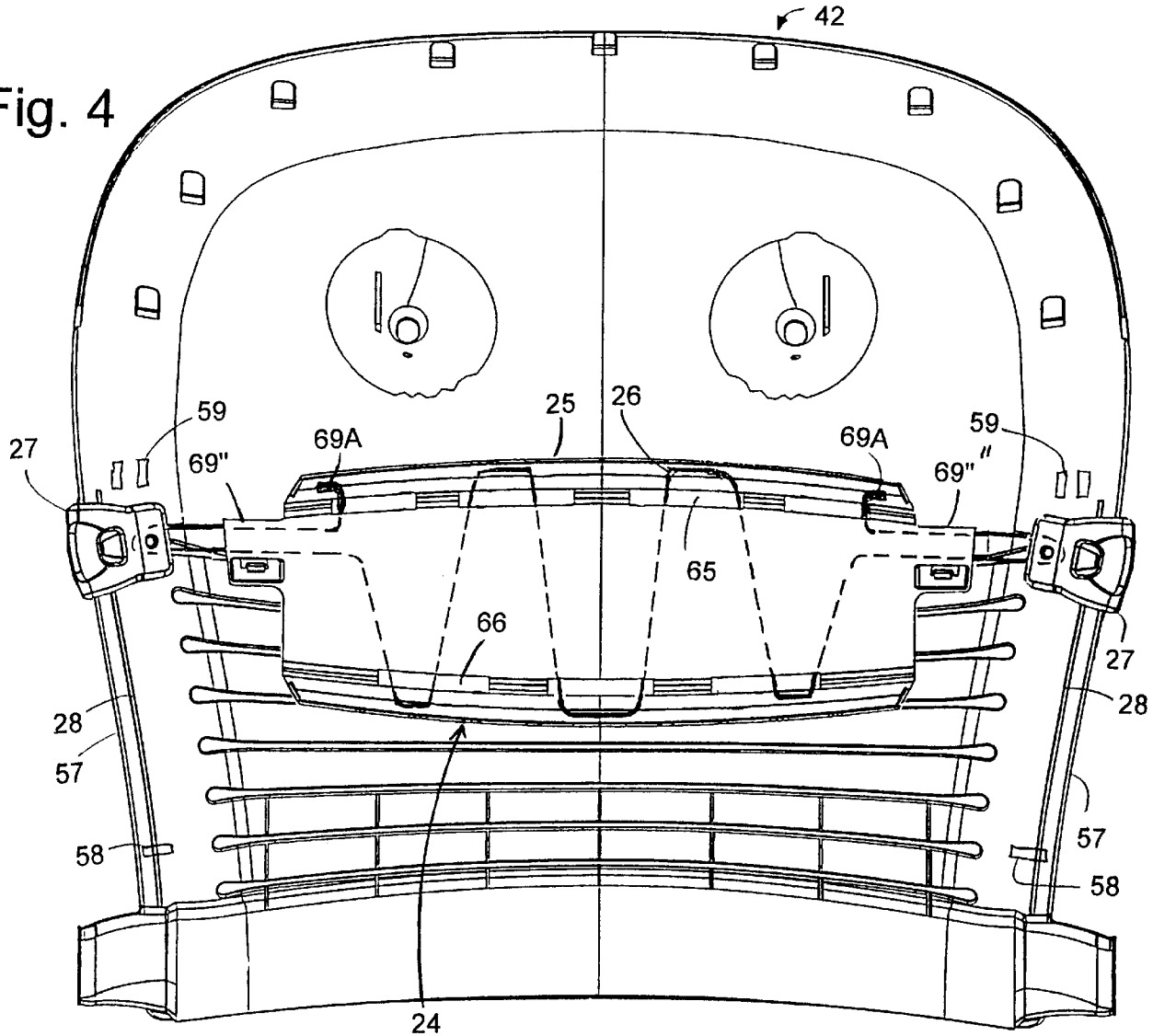
FIG. 4 is a front view similar to FIG. 3, but with the lumbar support mechanism shown in a raised position.

The back construction 42 (FIG. 2) includes top and bottom front cushions 55 and 56, each of which includes a foam insert and upholstery covering. The two-piece construction helps prevent the high flexibility of the back shell 21 from causing unacceptable wrinkling when using the chair 20. The back shell 21 (FIG. 3) includes non-parallel edges 57, and the guides 28 comprise raised ridges that run parallel to the edges 57 about a quarter to a half inch inboard of the edges 57. The guides 28 include depressions 28' (FIG. 5) forming an undulating or rough surface that acts as a detent, as described below. A lower stop 58 (FIG. 4) at a bottom of each guide 28 limits the downward movement of the lumbar support 24. Upper stops 59 limit upward movement of the lumbar support 24, yet permit assembly of the lumbar support 24 to the back shell 21, as described below.

Figure 11:
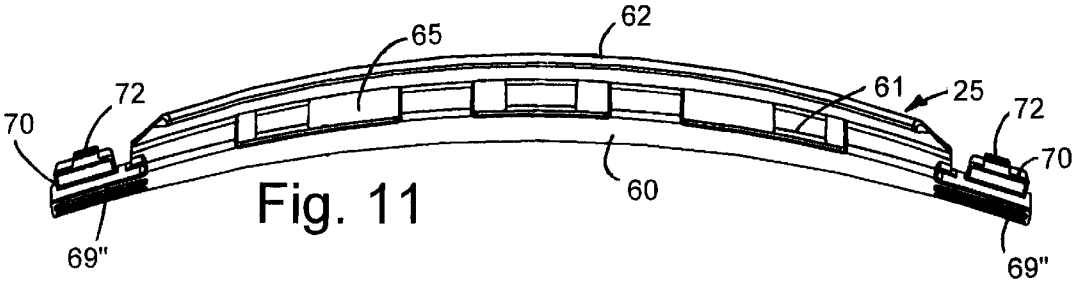
FIGS. 11 and 12 are top and front views of the lumbar panel body shown in FIG. 6.
Figure 12:
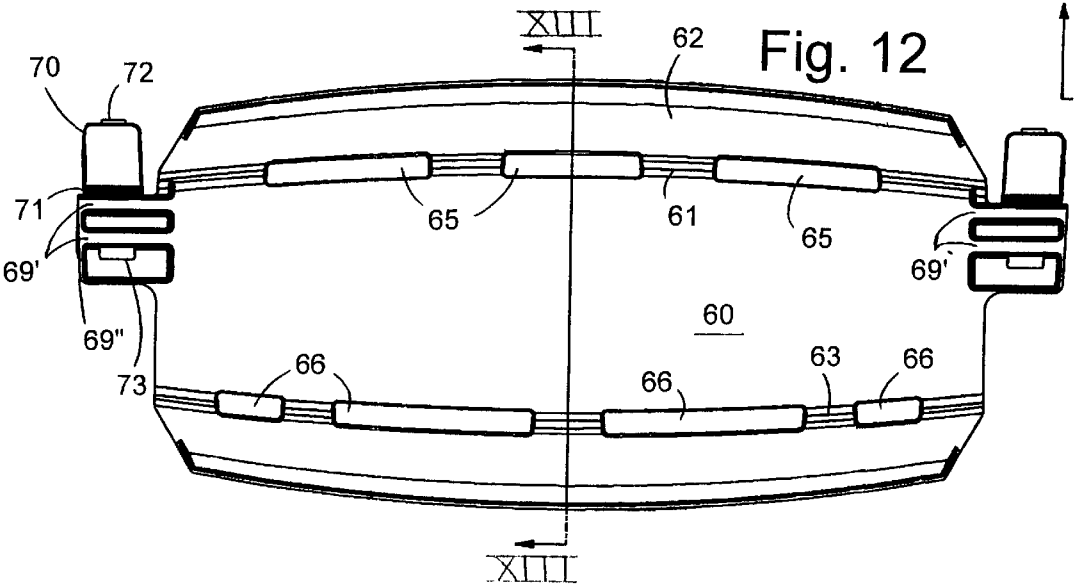

The panel body 25 (FIGS. 11–13) is a molded polymeric part that includes a sheet-like center section 60 formed to an optimal three-dimensional shape. A forwardly extending top flange 61 is formed along its upper edge, and an up flange 62 extends upwardly therefrom. A forwardly extending bottom flange 63 is formed along its lower edge, and a down flange 64 extends downwardly therefrom. Three elongated slots 65 are formed in the forwardly extending top flange 61, and at least two elongated slots 66 are formed in the forwardly extending bottom flange 63.

Figure 6:
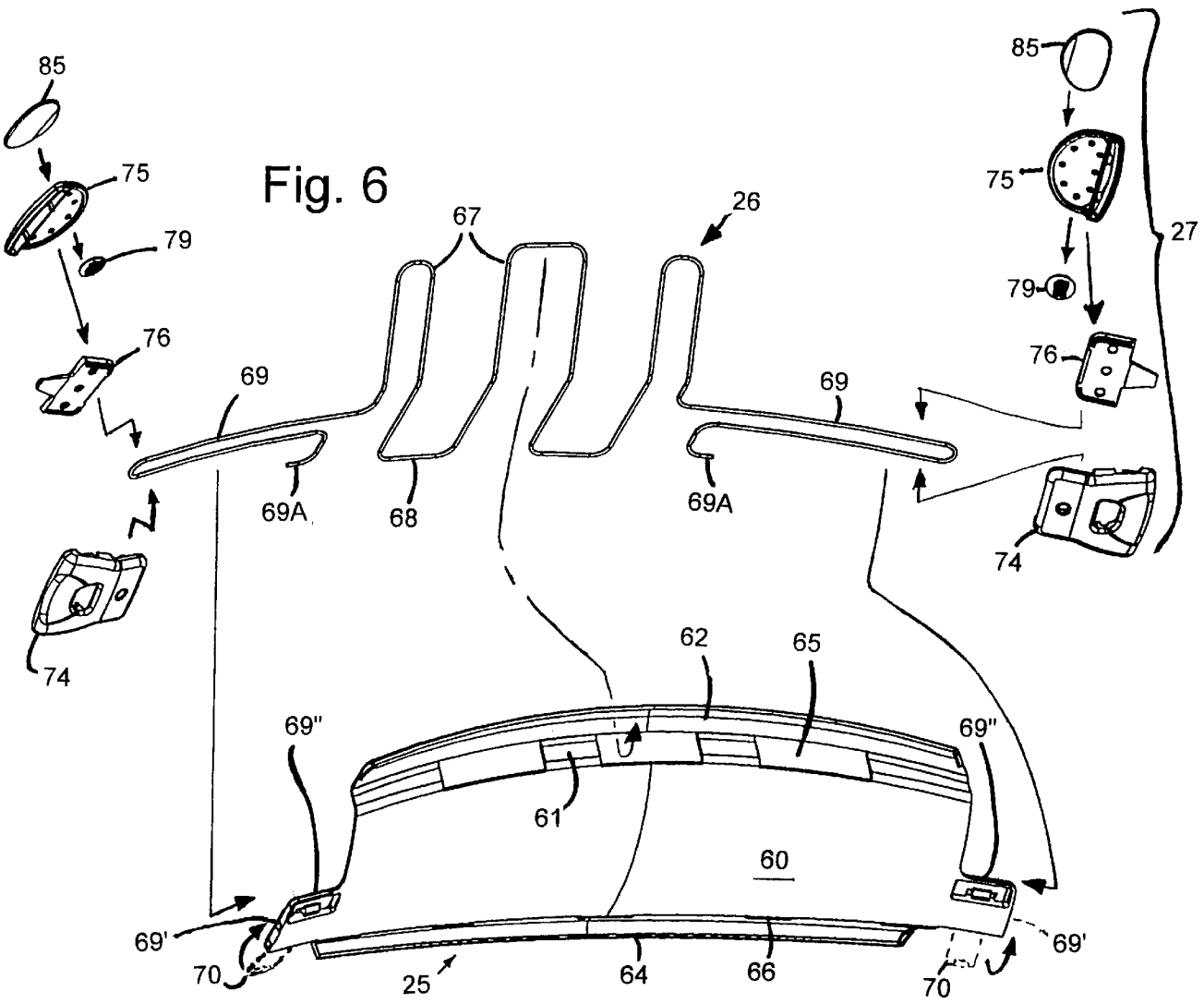
FIG. 6 is an exploded view of the lumbar support mechanism shown in FIG. 2.

The bent wire member 26 (FIG. 6) includes a center section having three up loops 67 that fit loosely into the slots 65, and two down loops 68 that fit loosely into slots 66. The bent wire member 26 further includes side loops 69 that fit slidably into horizontal grooves 69' in side wings 69" of panel body 25 to support handles 27. The loops 67 and 68 allow the bent wire member 26 to be laterally expandable. Thus, as the handles 27 follow guides 28 along the nonparallel edges 57, the loops 67 and 68 stretch so that the side loops 69 move with the handles 27. The slots 65 and 66 are large enough to accommodate this movement. At the same time, the slots 65 and 66 hold the bent wire member 26 closely adjacent the panel body 25, such that the bent wire member 26 and the panel body 25 help support each other for optimal postural support. An end retainer flap or "door" 70 is attached to each end of the panel body 25 and is supported by a living hinge 71. Snap-attachment hooks 72 and retainer apertures 73 are formed on the end flap 70 and on the material of panel body 25 adjacent the living hinge 71. The end flap 70 is configured to snap attach to the wings 69" of panel body 25 with hooks 72 engaging apertures 73 to securely hold the side loops 69 on the ends of the panel body 25.

Figure 14:
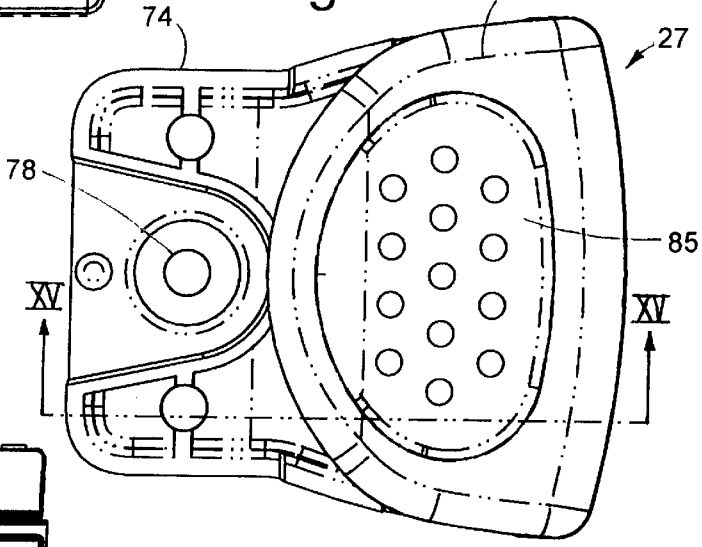
FIG. 14 is a rear view of the handle shown in FIG. 8.
Figure 14A:
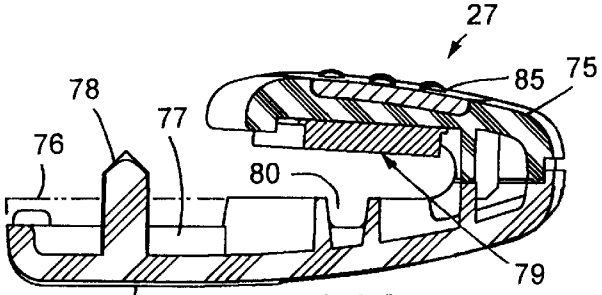
FIG. 14A is a cross-sectional view of the handle shown in FIG. 14, but before assembly to an end of the bent wire member and before assembly of the spring plate shown in FIG. 17.
Figure 9:
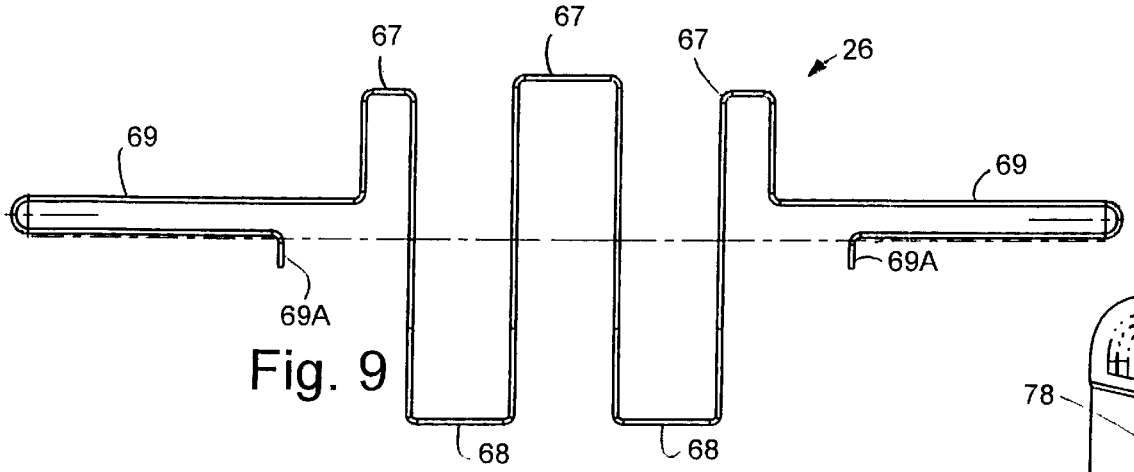

The handles 27 (FIG. 14A) each include a handle body 74, a handle backer 75, and a spring plate 76 subassembled onto the side loops 69. Specifically, the handle body 74 includes a channel 77 shaped to receive and engage one side of the side loops 69. The handle backer 75 is constructed to mateably engage an opposite side of the side loops 69. The handle body 74 and the handle backer 75 include mating attachment structures 74' and 75' that can be secured together (e.g., by sonic welding, gluing, snap attachment, or other means). A non-scuffing insert 79 of material (commonly known as Velcro® material) is attached to an inside of the handle backer 75 in a recess 75" for engaging a surface of the back shell 21 adjacent the guides 28. The insert 79 acts as a bearing to allow a uniform non-binding sliding movement along the edge 57 of back shell 21. The handle body 74 includes a groove 80 for engaging the guides 28, so that the handles 27 track along their respective guides 28. The spring plate 76 includes a retainer end 82 with a hole 82' for receiving stud 78 for attachment to the handle body 74, and further includes a leaf-spring-like finger 83 that extends adjacent the groove 80. The finger 83 resiliently engages the undulations on the guides 28, so that it provides a detented frictional engagement as the handle 27 is moved along the guides 28. This causes a frictional force that retains the lumbar support 24 in a selected position once the handle 27 (and the lumbar support 24) has been vertically adjusted. An aesthetic rubber insert 85 is insert molded or otherwise bonded to the handle body 74 for aesthetics and provides improved gripping of the handle 27 by a seated user. Ribs are provided on the handle body 74 and the handle backer 75 for strength and to improve their moldability.

Figure 7:
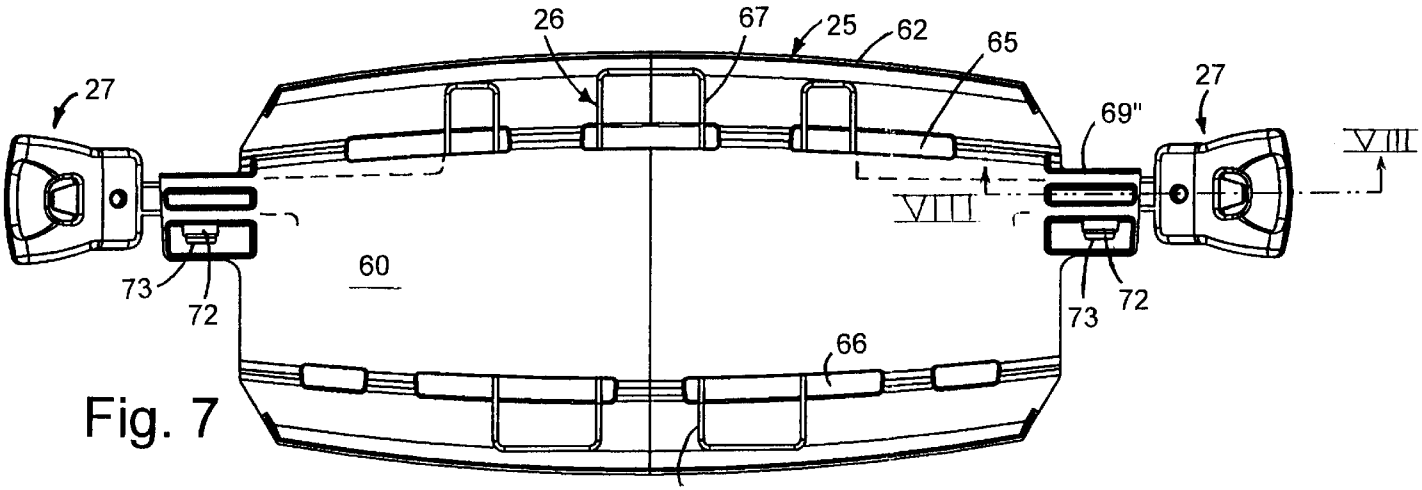
FIG. 7 is a front view of the lumbar support mechanism shown in FIG. 6.
Figure 8:
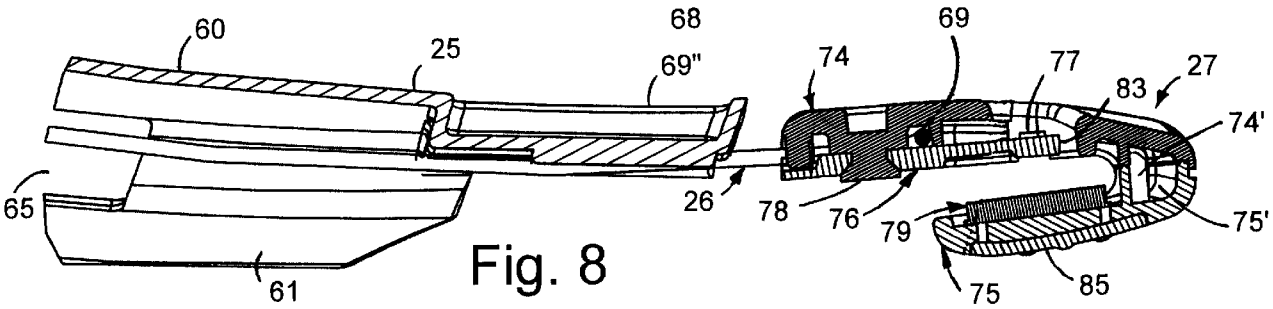
FIG. 8 is a cross-sectional view taken along line VIII—VIII in FIG. 7.

It is contemplated that various assemblies can be used. In one method of assembling the lumbar support 24, the up loops 67 of the bent wire member 26 are inserted upwardly into the top slots 65, until the down loops 68 can be inserted into the bottom slots 66. Thereafter, the bent wire member 26 is centered on the panel body 25, and the side loops 69 are secured by snap attaching the end retainer flaps 70 to the ends of the panel body 25 using living hinges 71 and hooks 72. The handles 27 are then attached to the side loops 69 by positioning and securing the handle body 74 against the handle backer 75, with the side loops 69 and the spring plates 76 held therebetween. The side loops 69 are stretched apart until the handles 27 can be slipped onto the edges 57 of the back shell 21. Thereafter, the handles 27 can be shifted downwardly with their grooves 80 frictionally engaging the guides 28. It is noted that this assembly can be accomplished in the field by slipping the lumbar support 24 in from a side of the chair 20 behind the bottom cushion and in front of the back shell 21 on a preassembled chair 20. This method of field installation is low cost and very easily done. Also, it is noted that the panel body 25 and bent wire member 26 can be designed so that the panel body 25 is inverted (compare FIGS. 3 and 7) or invertable as installed.

To vertically adjust the lumbar support 24, the user simply grasps the handles 27 and lifts upwardly. It is noted that in many designs only a single handle 27 need be grasped in order to move the lumbar support 24 upwardly without canting or causing the lumbar support 24 to twist. Such factors as the frictional engagement of the lumbar support 24 on the back shell 21 greatly affect the need for grasping both of the two handles 27. Another factor is the vertical width of the groove 80 in handle body 74, which vertical width can add considerable stability to the movement of the handle body 74 if it is great enough. Yet another factor is the frictional engagement between the spring plate 76 and the guides 28. It is specifically contemplated that only single handle 27 need be provided if desired. Notably, the up and down flanges 62 and 64, respectively, have generously radiused top and bottom edges so that they do not catch on any of the slits 49 as the lumbar support 24 is vertically adjusted. Also, the bands 22 of lumbar section 23 on the back shell 21 have generously radiused edges to prevent catching and binding. If desired, the free ends 69A can be hooked into one of the top slots 65 to prevent these free ends 69A from catching and to control stretching of the bent wire member 26.

In the foregoing description, it will be readily appreciated by persons skilled in the art that modifications may be made to the invention without departing from the concepts disclosed herein. Such modifications are to be considered as included in the following claims, unless these claims by their language expressly state otherwise.

The invention claimed is:

1. A back construction for a chair comprising:

a back member having a flexible lumbar section, the back member including non-parallel guides defined along opposing side edges of the back member; and a vertically adjustable lumbar support including a panel body located at the flexible lumbar section, a bent wire member that engages the panel body and that is stretchable laterally, and opposing handles that engage the non-parallel guides, the opposing handles engaging ends of the bent wire member and being movable between a first position on the non-parallel guides where the bent wire member is flexed to a first width dimension, and a second position on the non-parallel guides where the bent wire member is flexed to a second width dimension different than the first width dimension.

2. The back construction defined in claim 1, wherein the bent wire member carries the lumbar support panel body when the lumbar support is vertically adjusted.

3. The back construction defined in claim 2, wherein the bent wire member has multiple looping sections that engage the panel body.

4. The back construction defined in claim 3, wherein the panel body has slots for loosely receiving the looping sections.

5. The back construction defined in claim 4, wherein the guides include undulations that provide friction for holding the handles at an adjusted position.

6. The back construction defined in claim 5, wherein the flexible lumbar section is very flexible and is constructed to change shape as the panel body is moved vertically across the back member.

7. The back construction defined in claim 3, wherein the bent wire member is a continuous wire segment with alternating up and down loops.

8. The back construction defined in claim 7, wherein the handles include a snap-attach holder configured to grip side loops on the bent wire member.

9. The back construction defined in claim 8, wherein the snap-attach holder is connected to the panel body by living hinges.

10. The back construction defined in claim 8, wherein the handles are configured to swivel on the side loop of the bent wire member as handles follow the edges of the back member.

11. The back construction defined in claim 1, wherein the back member comprises a polymeric shell and the handles engage front and rear surfaces of an edge of the shell.

12. The back construction defined in claim 11, wherein the guides comprise ridges along edges of the shell and the opposing handles include grooves mateably engaging the ridges.

13. The back construction defined in claim 12, wherein the ridges each include a non-uniform surface and the opposing handles frictionally engage the non-uniform surfaces.

14. The back construction defined in claim 13, wherein the handles include a spring plate for frictionally engaging the non-uniform surfaces with a detent action.

15. The back construction defined in claim 1, wherein the flexible lumbar section includes horizontally extending bands of material defined by horizontal slits, and the panel body of the lumbar support has generously rounded upper and lower edges for gliding over the slits onto the bands during vertical adjustment of the lumbar support.

16. A back construction comprising:

a back member including a flexible lumbar section with horizontal slits defining a plurality of horizontal bands, the lumbar section being flexible and readily bendable to different concave shapes; and a vertically adjustable lumbar support including a panel body configured to vertically slidably engage the flexible lumbar section and bend the flexible lumbar section to a shape generally matching the panel body, and including at least one handle for moving the panel body, the panel body including generously radiused upper and lower edges shaped to slide over top and bottom edges of the plurality of horizontal bands without catching on and unacceptably twisting individual ones of the bands when the vertically adjustable lumbar support is vertically adjusted.

17. A method comprising steps of:

providing a chair including a back shell and a cushion supported on the back shell;

providing a lumbar support; and after the chair is fully constructed and adapted for use, installing the lumbar support on the back construction by inserting the lumbar support from an edge of the back construction between the back shell and the cushion without removing the cushion, including attaching the lumbar support to a vertically extending guide on the back shell.

18. A lumbar support apparatus for chairs comprising:

a lumbar support including a panel body with upper and lower edges opposing side edges, and retainers; and a horizontally extendable carrier including upper and lower sections that slidably engage the retainers to hold the horizontally extendable carrier adjacent the panel body of the lumbar support, but that are constructed to permit the horizontally extendable carrier to extend horizontally as the panel body of the lumbar support is moved vertically on a chair back; the horizontally extendable carrier including upper and lower edges that engage the retainers; the carrier comprising a bent wire having vertically extending looping sections, such that the carrier is horizontally extendable.

19. The lumbar support apparatus defined in claim 18, wherein the retainers include slots for receiving the looping sections.

20. A lumbar support for chairs comprising:

a panel body shaped to provide lumbar support and having sides defining retainers;

laterally extending wire sections slidably engaging the retainers; and handles attached to the wire sections.

21. The lumbar support defined in claim 20, wherein the retainers define laterally extending grooves that slidingly receive and engage the wire sections.

22. The lumbar support defined in claim 21, wherein the handles each include a surface extending at an angle to the grooves that is configured to engage and follow a vertical track on a chair back.

* * * * *